US009810007B2

(12) United States Patent
Bendel et al.

(10) Patent No.: US 9,810,007 B2
(45) Date of Patent: Nov. 7, 2017

(54) METHOD FOR PRODUCING MOTOR VEHICLE DOOR LOCKS WITH A ROLLING SURFACE AS A LOCKING PART CONTOUR

(71) Applicant: Kiekert Aktiengesellschaft, Heiligenhaus (DE)

(72) Inventors: Thorsten Bendel, Oberhausen (DE); Werner Pohle, Dortmund (DE); Thomas Waldmann, Mulheim Ruhr (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/650,607

(22) PCT Filed: Dec. 11, 2013

(86) PCT No.: PCT/DE2013/000772
§ 371 (c)(1),
(2) Date: Jun. 9, 2015

(87) PCT Pub. No.: WO2014/090217
PCT Pub. Date: Jun. 19, 2014

(65) Prior Publication Data

US 2015/0308164 A1 Oct. 29, 2015

(30) Foreign Application Priority Data

Dec. 12, 2012 (DE) ..... 10 2012 024 302

(51) Int. Cl.
*E05C 3/06* (2006.01)
*E05B 85/22* (2014.01)
(Continued)

(52) U.S. Cl.
CPC ..... *E05B 85/22* (2013.01); *B21D 5/00* (2013.01); *B21D 22/02* (2013.01); *B21D 53/38* (2013.01);
(Continued)

(58) Field of Classification Search
CPC ..... E05B 85/243; E05B 79/10; E05B 85/22; E05B 77/36; E05B 85/26; E05B 77/40; B21D 53/88; B21D 35/00; B21D 5/00
(Continued)

(56) References Cited

U.S. PATENT DOCUMENTS 4,235,462 A * 11/1980 Torii ..... E05B 77/38 292/216
4,358,141 A * 11/1982 Hamada ..... E05B 85/243 292/216
(Continued)

FOREIGN PATENT DOCUMENTS

DE 102007060626 A1 6/2009
DE 102010009041 A1 10/2010
DE 102010009141 A1 8/2011

OTHER PUBLICATIONS

Machine Translation of DE102010009141A1 by Lexis Nexis Total Patent dated Aug. 20, 2015.
(Continued)

*Primary Examiner* — Kristina R Fulton
*Assistant Examiner* — Faria F Ahmad
(74) *Attorney, Agent, or Firm* — Woodard, Emhardt, Moriarty, McNett & Henry LLP

(57) ABSTRACT

The invention relates to a method for producing motor vehicle door locks with the locking parts: a rotary latch and a pawl. Said latch and the pawl are stamped from rolled sheet metal defining vertical or approximately vertical edges with corresponding latch surfaces on the rotary latch and the
(Continued)

pawl, and subsequently are provided with a covering while maintaining the catch surfaces. After stamping, the locking parts are bent in the region of the main latch and/or another latch resulting in the formation a contour which is void of stamped channels, and are then inserted into the lock housing box.

20 Claims, 3 Drawing Sheets

(51) Int. Cl.

| | |
|---|---|
| ***B21D 53/38*** | (2006.01) |
| ***E05B 77/36*** | (2014.01) |
| ***E05B 85/26*** | (2014.01) |
| ***B21D 5/00*** | (2006.01) |
| ***B21D 22/02*** | (2006.01) |
| ***E05B 79/10*** | (2014.01) |
| *E05C 3/04* | (2006.01) |
| *E05C 3/16* | (2006.01) |
| *E05B 77/40* | (2014.01) |

(52) U.S. Cl.
CPC ..... *E05B 77/36* (2013.01); *E05B 79/10* (2013.01); *E05B 85/26* (2013.01); *E05B 77/40* (2013.01)

(58) Field of Classification Search
USPC ..... 292/195, 201, 216, 210, DIG. 23
See application file for complete search history.

(56) References Cited

U.S. PATENT DOCUMENTS 6,010,164 A * 1/2000 Yoda ..... E05B 77/02 292/216
8,282,141 B2 * 10/2012 Paing ..... B60N 2/01583 292/216
2003/0034655 A1 * 2/2003 Mejean ..... E05B 81/14 292/201
2005/0121922 A1 * 6/2005 Cetnar ..... E05B 81/20 292/216
2006/0012185 A1 * 1/2006 Kiehl ..... E05B 85/26 292/216
2006/0279090 A1 * 12/2006 Ottino ..... E05B 85/26 292/216
2006/0284426 A1 * 12/2006 Bigazzi ..... E05B 81/14 292/216
2007/0029814 A1 * 2/2007 Coleman ..... E05B 81/14 292/201
2007/0210588 A1 * 9/2007 Cetnar ..... E05B 77/26 292/216
2008/0224482 A1 * 9/2008 Cumbo ..... E05B 77/02 292/216
2009/0145182 A1 * 6/2009 Bettin ..... E05B 81/20 70/237
2009/0295174 A1 * 12/2009 Corrales ..... E05B 81/14 292/169.14
2010/0072761 A1 * 3/2010 Tomaszewski ..... E05B 77/26 292/201
2011/0012376 A1 * 1/2011 Hunt ..... E05B 85/26 292/216
2011/0133491 A1 * 6/2011 Perkins ..... E05B 77/10 292/216
2011/0193353 A1 * 8/2011 Schiffer ..... E05B 85/26 292/216
2012/0126549 A1 * 5/2012 Papanikolaou ..... E05B 77/38 292/195
2015/0037534 A1 * 2/2015 Schott ..... B21D 5/04 428/121
2015/0308166 A1 * 10/2015 Bendel ..... E05B 77/36 292/195
2015/0315827 A1 * 11/2015 Bendel ..... E05B 77/36 292/195
2015/0315828 A1 * 11/2015 Bendel ..... E05B 77/40 292/195
2015/0315829 A1 * 11/2015 Bendel ..... E05B 85/26 292/195
2015/0330119 A1 * 11/2015 Bendel ..... E05B 85/26 292/195
2015/0354035 A1 * 12/2015 Mizuta ..... B21D 22/208 148/504
2016/0200363 A1 * 7/2016 Ito ..... B21D 22/20 428/595
2016/0279692 A1 * 9/2016 Ito ..... B21D 22/26
2016/0318093 A1 * 11/2016 Maki ..... C21D 8/0278
2016/0368536 A1 * 12/2016 Cazes ..... C21D 9/0068
2017/0021870 A1 * 1/2017 Ito ..... B21D 19/08

OTHER PUBLICATIONS

Machine Translation by Lexis Nexis Total Patent of DE102007060626A1 dated Jun. 20, 2015.
Machine Translation by Lexis Nexis Total Patent of DE102010009041A1 dated Jun. 20, 2015.

* cited by examiner

METHOD FOR PRODUCING MOTOR VEHICLE DOOR LOCKS WITH A ROLLING SURFACE AS A LOCKING PART CONTOUR

CROSS-REFERENCE TO RELATED APPLICATIONS

This application is the U.S. national stage application of International Patent Application No. PCT/DE2013/000772, filed Dec. 11, 2013, which claims priority of German Application No. 10 2012 024 302.2, filed Dec. 12, 2012, which are both hereby incorporated by reference.

BACKGROUND

Procedure for the manufacture of motor vehicle latches with a rolling surface as a locking mechanism contour.

The invention relates to a procedure to produce the locking mechanisms catch and pawl of a motor vehicle latch, whereby the locking mechanism is stamped out from rolled sheet metal with simulatingly vertical or virtually vertical edges with corresponding ratchet surfaces for the locking mechanism and is then equipped with a casing, with the ratchet surfaces then being kept free. The invention also concerns a motor vehicle latch with a locking mechanism which locks the catch in the closed state, whereby the locking mechanism demonstrates corresponding ratchet surfaces on the edges arising during stamping of the locking mechanisms at the free end of the locking mechanisms and casing which leaves the ratchet surfaces free.

It is basically known to reduce the creaking noises arising during driving of the motor vehicle which can occur between the bracket side and the catch if either the bracket side or the catch are equipped with a surface structure in the contact area of both which contributes to reduction of sliding friction. Thus in accordance with DE 10 201 0 009 041 A1 grooves or relevant bars are applied on the bracket side in the contact area obliquely to the longitudinal axis of the bracket side. The aim of this is to reduce the known creaking as mentioned.

However, the creaking or the stick-slip effect predominantly occurs between the locking mechanism on the main ratchet, i.e. the latch in which the pawl prevents the catch in rotating back and opening the motor vehicle latch again. During the subsequent opening process, the pawl is then unscrewed from the closure position via the handle, whereby the ratchet surfaces coming into contact with both locking mechanisms cause intensive friction. Consequently, the grooves arising during stamping can lead to a further creaking noise. Even with oblique stamping grooves in accordance with DE 10 2007 060 626 A1 the detrimental noises cannot be completely prevented.

SUMMARY

The present invention is based on the task of creating a manufacturing procedure and a motor vehicle latch in which the creaking between the locking mechanism is prevented.

The task is procedurally solved by the fact that the locking mechanisms are bent after stamping in the area of the main ratchet and/or another latch, giving a stamping groove-free contour and are then used in the latch casing box.

The locking mechanisms, i.e. both the pawl and the catch are stamped out of the rolled sheet metal. Consequently, the surfaces of both locking mechanisms are smooth. The invention utilises this by at least one of the free ends of the locking mechanisms being bent in the area of the main ratchet and/or also other latch areas. Consequently, no free end of a stamping part fits closely against another free end of a stamping part, but due to the bending of an end of a locking mechanism or also both ends the bent rolled surface of the locking mechanism(s) lie adjacent to one another. Consequently, the stamping contours showing grooves during the movement process of both locking mechanisms with one another can no longer have any effect. Thus, the detrimental creaking noises described can no longer occur and the free ends standing against one another with the grooves arising as a result of stamping and then interlocking with one another is also precluded.

According to an appropriate design of the invention it is envisaged that a locking mechanism is bent and then mounted after stamping in the area of the main ratchet and/or another latch and in the mounted state is brought into contact with the free stamped end of the other locking mechanism and thus a straight stamping contour. This means that only one free end of a locking mechanism is bent, while the other remains as it is. Consequently, now the stamping groove-free contour of the bent end lies adjacent against the end which demonstrates the stamping contours and the grooves. Due to the bent rolled surface, even with a marked stamping contour with straight grooves, detrimental noises and an aggravation of the movement process of the pawl along the catch can no longer occur.

The ratchet surface of both locking mechanisms which come into contact during the movement process or also during supporting of the catch by the pawl are greatly reduced by area, if, as provided for in accordance with the invention, the free end to be bent is slightly deformed in a crescent shape around its transverse axis during bending of the free end of the stamped locking mechanism. The shape of the angular deflection or the crescent-shaped angular deflection is selected in such a way that only a slight contact surface or a slightly larger contact surface remains between the two locking mechanisms, according to how this proves appropriate with one motor vehicle latch or another.

Another possibility for reducing the size of the contact surface in the area of the ratchet surfaces is to bend the free end slightly around its longitudinal axis or to mill off the free end during angular deflection of the free end of the stamped locking mechanism. Consequently, a slightly rounded back is formed in the centre. Here too the movement process can be taken into account by the design of the back, whereby milling off has the advantage that grooves are formed as a result which are inclined to the vertical stamping contour of the other locking mechanism to a certain extent. This also ensures a certain reduction of sliding friction.

In accordance with the device, it is envisaged for solution of the task that the locking mechanisms at their free end demonstrating a stamping contour demonstrate an angular deflection. Consequently, their rolled locking mechanism surface must be abutted against the free end of the adjacent locking mechanism. A locking mechanism designed thus or relevantly designed locking mechanisms make it possible for the catch and the pawl not to lie adjacent to the free end demonstrating a stamping contour, but instead with the rolled locking mechanism surface which, due to the smoothness arising as a result of rolling precludes the occurrence of the detrimental stick-slip effect.

According to an appropriate design form, it is envisaged that the pawl demonstrates a free end with a stamping contour with an angular deflection and the catch a free end directed against the angular deflection and to be abutted or that the free end of the catch is formed via the angular deflection. Such a design is appropriate because the manufacturing cost is reduced because only one of the two free ends of one of the locking mechanisms needs to be bent while the other free end remains in action with its stamping contour. The stamping contour remaining on the free end of the catch for example is harmless with regard to noise because the available grooves of the stamping contour can roll out easily on the smooth surface of the deflection or can move in a loop. This also applies if only the catch for example possesses an angular deflection while the free end of the catch demonstrates the inherently disadvantageous stamping grooves.

In order to facilitate appropriate angular deflection it is envisaged that the pawl on the free end has a reduced sheet metal thickness and the protruding end piece is bent. If we assume that the pawl is a component with a thickness of approximately 4 mm, the sheet metal thickness would be reduced to approximately 2 mm at the free end in order to bend or deflect the protruding end piece whereby this has the advantage of the pawl then easily being able to lie adjacent to the floor of the latch box casing.

If such a reduction of the angular deflection is not possible, in accordance with the present invention of the pawl, supplementary sheet metal should be assigned which has a thickness which offsets the height of the angular deflection. In this design too, the angular deflection would not be able to impair the positioning of the pawl in the latch box casing because smooth positioning of the pawl on the floor of the latch box casing is ensured.

If a lesser contact surface needs to be attained for example between the pawl and the catch, this is made possible by the pawl or the catch demonstrating a rolled angular deflection at the free end. On the one hand, the thickness of the potential supplementary sheet metal can be made smaller and on the other hand it is thus possible to further reduce the actual ratchet surface, i.e. the surface in which the locking mechanism comes into contact, because contact between the locking mechanisms is only possible in the strip-shaped lengthwise direction of the rolled angular deflection. Due to the shaping of the rolled angular deflection or its back, the dimensions of the effective angular deflection can be determined accurately.

This is also similar if the angular deflection has a slight crescent shape over its length, whereby the installation takes place in the centre of the crescent and with regard to the dimensions the size of the installation can be attained and set by relevant processing or shaping of the crescent-shaped angular deflection.

The invention is characterised in particular by a motor vehicle being able to be created with low additional manufacturing costs in which the pawl and the catch are designed in the latch area, i.e. in the area where they both lie on top of or adjacent to one another, in such a way that the previous noise pollution is considerably reduced or completely prevented. Furthermore, a uniform movement along the catch is ensured because due to the special design of the pawl or the catch the available grooves of the stamping contour cannot react with one another because the relevant stamping contour of one of the two locking mechanisms or also of both locking mechanisms is bent, i.e. manoeuvred into a different position. The different grooves produced during stamping are therefore unable to interlock and lead to harmful noises. However, 'removal' of the problematic ratchet surface of one of the locking mechanisms from the movement process also has the advantage that the locking mechanism surface now available is especially smooth. Consequently, the movement process is encouraged between the locking mechanism.

Further details and advantages of the object of the invention result from the following description of the pertaining sketch in which a preferred design example is outlined with the necessary details and individual parts. The following are shown:

DETAILED DESCRIPTION OF THE DRAWINGS

Figure 1:
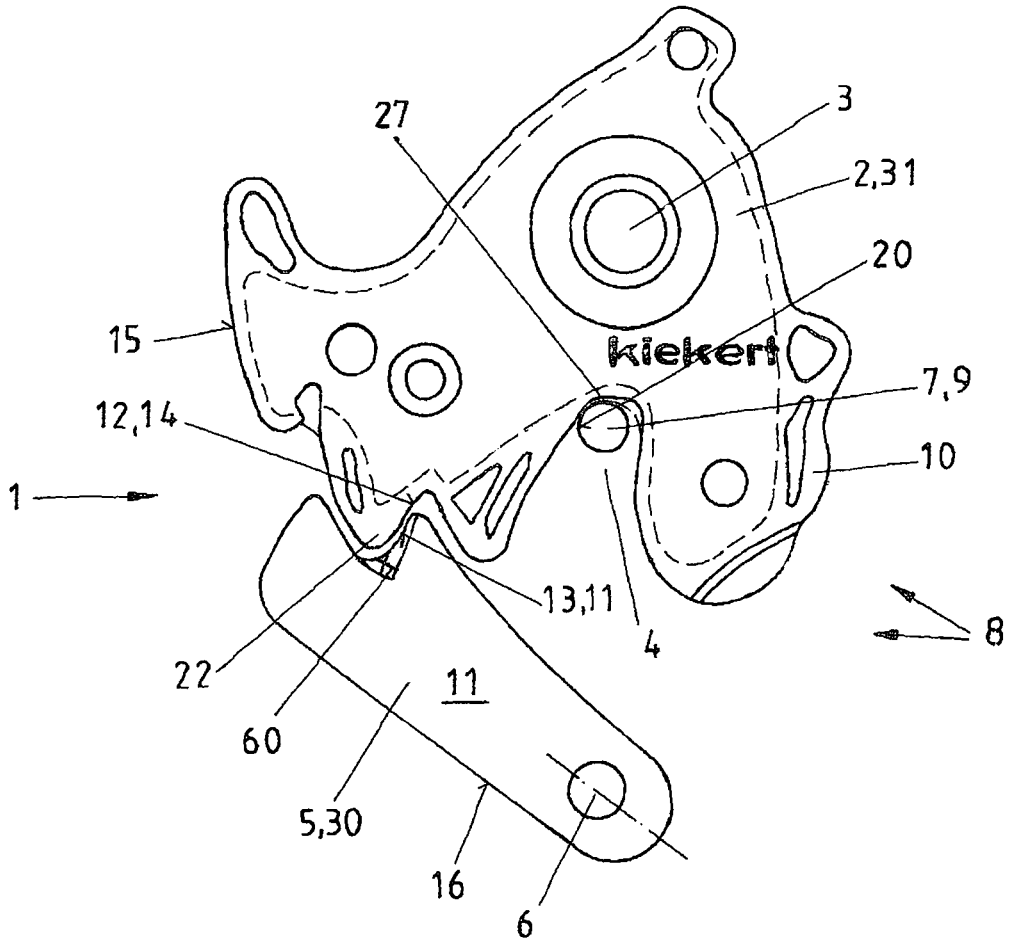
FIG. 1 a top view of a motor vehicle latch in the closed state
Figure 2:
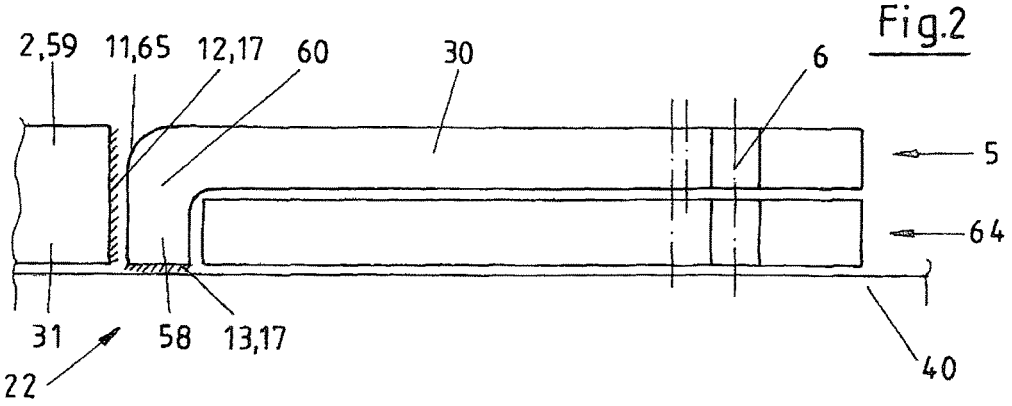
FIG. 2 a side view of a pawl with angular deflection on the free end and assigned supplementary metal sheet, FIG. 3 compared to FIG. 2, the crescent-shaped angular deflection of the free end of the pawl, FIG. 4 a top view of a pawl angular deflection FIG. 5 a side view of a pawl with a further design of the angular deflection and FIG. 6 a perspective reproduction of the catch with the special edge formation

FIG. 1 shows a top view of a motor vehicle latch 1, in which the catch 2 moving around the axis 3 encompasses the bracket side 9 of the latch bracket 7. The closed state of the motor vehicle latch 1 is reproduced here, whereby the catch 2 is secured via the pawl 5 pivotable around the pawl axis 6, i.e. the motor vehicle latch 1 can only be opened again if the pawl 5 has been pivoted away previously which is possible via the handle of the motor vehicle door which is not reproduced here. The bracket side 9 is moved towards the catch 2 via the mounting 4 into the deep base 27 and thus ensures the closed state of the motor vehicle door also not shown here, whereby the locking mechanisms 30, 31, i.e. the pawl 5 and the catch 2 are parts of the motor vehicle door, while the latch bracket 7 is determined with the bracket 9 on the chassis of the motor vehicle. The locking mechanisms 30, 31 of the latch 8 are produced in a stamping process preferably comprising several components from relevantly rolled sheet metal, whereby on the ratchet surfaces 12, 13 kept free from the casing 10 initially the surface of both locking mechanisms 30, 31 is identified by a stamping contour 14. This surface design on the two free ends 58, 59 of the catch 2 and the pawl 5 would lead to an impacting of the movement process and in particular to noise because there straight grooves 17 have arisen as a result of the stamping process. Relevant details are indicated in FIG. 2. In the design apparent from the figure, in the area of the main ratchet 22 the free end 58 with the ratchet surface 13 and the straight grooves 17 is bent. Consequently, the angular deflection 60 shown arises. Due to this angular deflection 60 the rolled locking mechanism surface 11 is now adjacent to the stamping contour 14 with the ratchet surface 12 of the catch 2 demonstrating the straight grooves 17. Thus, the detrimental noises outlined can no longer occur or can only occur to a limited extent.

It is not particularly emphasised that the edges 15, 16 of the catch 2 and the pawl 5 are equipped with casing 10. The edges 15, 16 are thus covered by such a casing 10. The casing 10 is only not present in the area of the ratchet surfaces 12, 13 and also the contact surface 20 between the catch 2 and the bracket side 9. Consequently, the special surface structure as can be found in the following figures can become effective. The surface structure ensures minimisation of noise and sliding friction which both also interact.

FIG. 2 shows a side view of the pawl 5, whereby it is clear that this pawl 5 is pivotable around the pawl axis 6 in such a way that the pawl 5 can move over the floor of the latch box casing 40. In the area of the main ratchet 22 the free end 59 of the locking mechanism 31 stands with the stamping contour 14 against the free end 58 of the pawl 5 which demonstrates an angular deflection 60. Thus, the locking mechanism surface 11 with its rolled smooth surface is adjacent to the free end 59 of the catch 2. Consequently, the straight grooves 17 present there cannot be made detrimentally perceptible. The straight grooves 17 on the ratchet surface 13 present on the free end 58 of the pawl 5 also cannot be made detrimentally perceptible as they are removed from the area of the contact surface 65 due to the angular deflection 60.

In order not to impede the movement of the pawl 5 in the latch casing or latch box casing 40, the pawl 5 is secured here by a supplementary metal sheet 64 which demonstrates a thickness which roughly corresponds to the height of the angular deflection 60.

Figure 3:
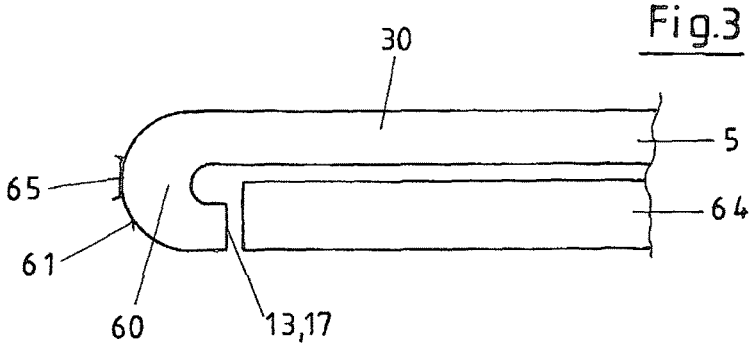
Figure 4:
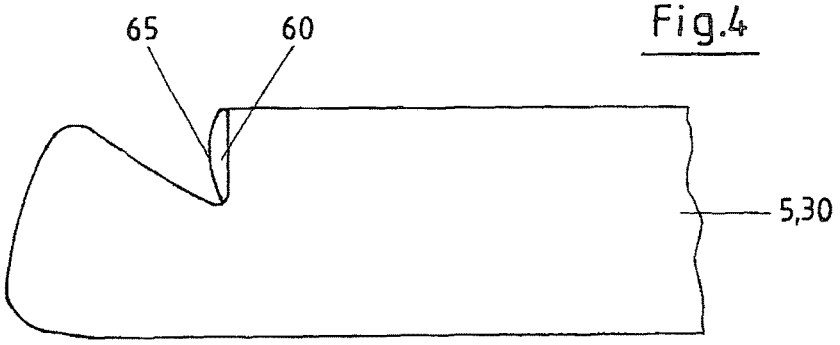
Figure 5:
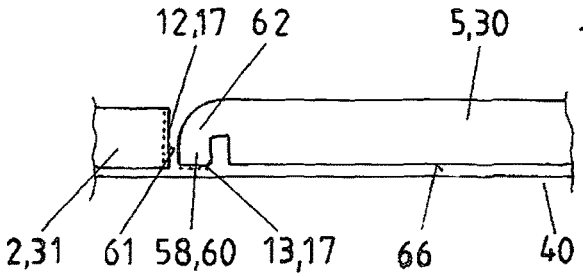

FIG. 3 shows a special form of the deflection 60 which is designed in a crescent shape here. Consequently, a reduced contact surface 65 arises. This part of the angular deflection can demonstrate precisely the locking mechanism surface 61 as the remaining area or it is treated or designed separately, by coating for example. Here too it becomes clear that the ratchet surface 13 with the straight grooves 17 present is unharmful because it is bent relevantly wide. The pawl 5 and supplementary metal sheet 64 move together. In the design in accordance with FIG. 4 the angular deflection 60 is shaped in such a way that a crescent-shaped contact surface 65 is produced which also entails reduction of the ratchet surface 13 (contact surface 65) again. Due to the size of the crescent or its design the size of the contact surface 65 can also be varied between the two locking mechanisms 30, 31. FIG. 5 shows a pawl 5 in which the free end 58 demonstrates an end piece 62 in which the thickness of the pawl 5 is reduced. Consequently, the angular deflection 60 can be easily produced accordingly. First and foremost, the necessity of a supplementary metal sheet ceases to apply because the angular deflection 60 does not protrude beyond the underside 66 of the pawl 5. It is clear that here too that due to the angular deflection 60 the locking mechanism surface 61 which is smooth because rolled comes into contact with the ratchet surface 12 of the pawl 2 which demonstrates the straight stamping grooves 17.

Figure 6:
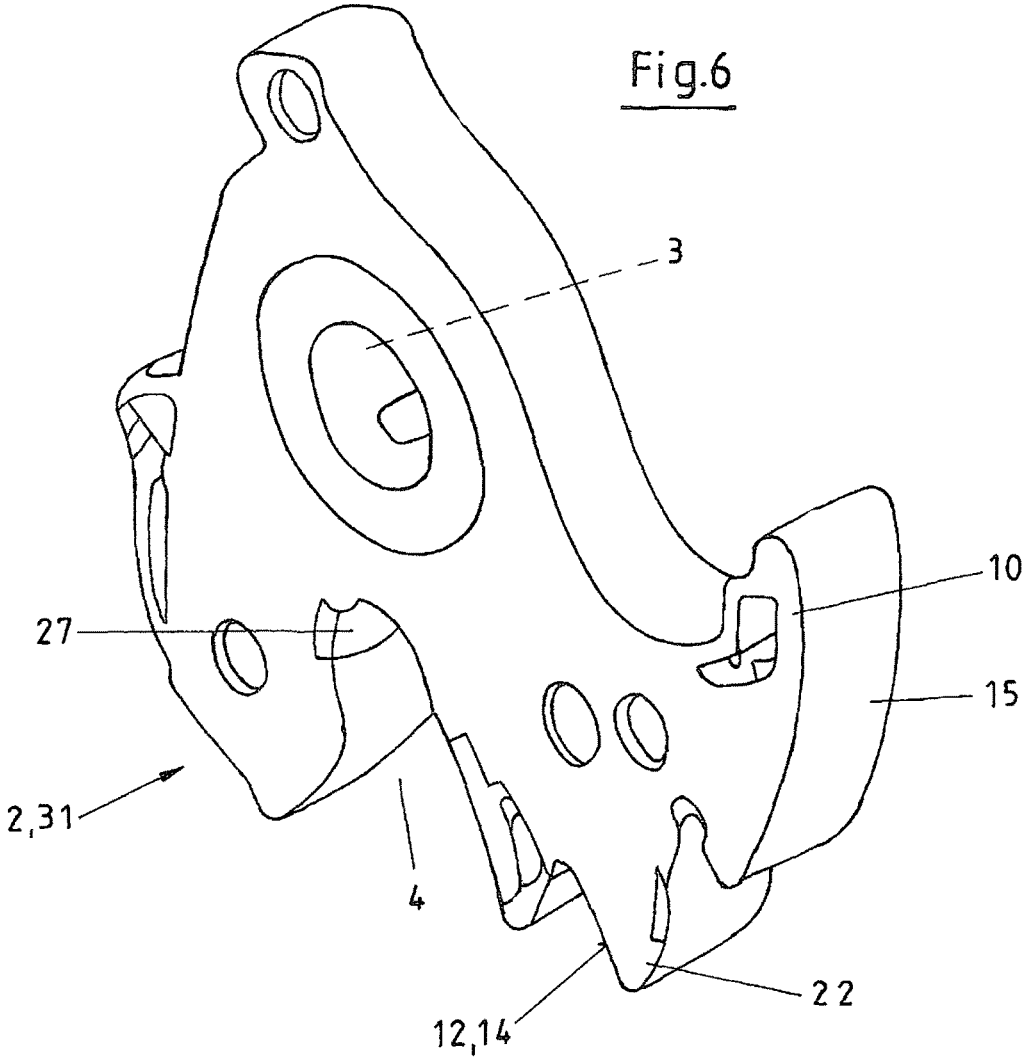

Finally, FIG. 6 shows a perspective view of a catch 2 which can be pivoted here around the axis 3. When the catch 2 is pivoted, the bracket side 9 which is not shown in FIG. 5 is inserted into the mounting 4 and subsequently freed by this. Consequently, the vehicle door can be opened or closes. In the closure position in accordance with FIG. 1, the catch is stopped by the pawl 5. It is clearly recognisable in FIG. 6 that the stamping of the catch 2 leads to a clearly recognisable edge 15, the surface of which is marked by the stamping contour 14 as explained above which is predominantly marked on the ratchet surface 12. This stamping contour 14 is only indicated in FIG. 6. The ratchet surface 12 marks the main ratchet 22, i.e. the position in which the pawl 5 hinders the catch 2 in the closed position on a reverse pivot. Then, as also already mentioned, the locking mechanism surface 61 is adjacent in the angular deflection 60 on the ratchet surface 12 of the catch 2 and both can push past one another with reduced friction without detrimental noises occurring because the straight grooves 17 of the catch 2 cannot interlock or lock into place on the rolled locking mechanism surface 61. Smooth pushing past one another is guaranteed without separate noise pollution occurring.

In the deep base 27 of the mounting 4 it is recognisable that here a surface which deviates from the remaining surface of the edge 15 is present, which is attained in particular by no casing 10 being present here. It is recognisable that here too a separate part is pushed in in order to have a positive impact on the sliding effect of the catch 2 on the bracket side 9.

All stated characteristics, including those taken from the sketches alone, are viewed as crucial to the invention alone and jointly.

The invention claimed is:

1. A motor vehicle latch made by the process comprising:

providing a stamped catch having a first free end, a first stamped side on the first free end, the first stamped side having stamping contours, and a first side surface adjacent to and perpendicular to the first stamped side, wherein the stamped catch is a first locking component and wherein the stamped catch defines a first ratchet surface on the first free end;

providing a stamped pawl which locks the stamped catch in the closed state, the stamped pawl having a second free end, a second stamped side on the second free end, the second stamped side having stamping contours and a second side surface adjacent to and perpendicular to the second stamped side, wherein the stamped pawl is a second locking component and wherein the stamped pawl defines a second ratchet surface on the second free end; and bending one of the first or second locking components at its respective first or second free end thereby positioning the first or second side surface as the first or second ratchet surface that abuts the first or second ratchet surface of the other locking component.

2. Motor vehicle latch in accordance with claim 1, wherein the first or second ratchet surface of the other locking component is the first or second stamped side having stamping contours.

3. Motor vehicle latch in accordance with claim 1, wherein the pawl on the second free end is reduced in a thickness and the second free end is bent.

4. Motor vehicle latch in accordance with claim 1, wherein the bent pawl or the catch demonstrate a rolled angular deflection at the first or second free end.

5. Motor vehicle latch in accordance with claim 1, wherein bending the first or second locking component creates an angular deflection that has a slight crescent shape over its length.

6. Motor vehicle latch in accordance with claim 1, wherein the pawl is assigned to a supplementary metal sheet which demonstrates a thickness which offsets the height of the angular deflection.

7. Motor vehicle latch in accordance with claim 2, wherein the pawl is assigned to a supplementary metal sheet which demonstrates a thickness which offsets a height of the bent free end.

8. Motor vehicle latch in accordance with claim 3, wherein the pawl is assigned to a supplementary metal sheet which demonstrates a thickness which offsets the height of the bent free end.

9. Motor vehicle latch in accordance with claim 4, wherein the pawl is assigned to a supplementary metal sheet which demonstrates a thickness which offsets the height of the bent free end.

10. Motor vehicle latch in accordance with claim 5, wherein the pawl is assigned to a supplementary metal sheet which demonstrates a thickness which offsets the height of the bent free end.

11. Motor vehicle latch in accordance with claim 1, wherein the bending is at least 90 degrees.

12. Motor vehicle latch made in accordance with claim 1, further comprising encasing the catch and pawl in a casing that leaves the first and second ratchet surfaces free.

13. Motor vehicle latch in accordance with claim 1, wherein the stamping contour of the free end of the bent first or second locking component cannot abut the adjacent locking component.

14. Motor vehicle latch in accordance with claim 1, wherein bending the free end of the first or second locking component positions a rolled surface against the free end of the adjacent other locking component.

15. Motor vehicle latch in accordance with claim 1, wherein a first ratchet surface on the first or second locking component has a stamped contour and wherein a second ratchet surface on the other locking component is a rolled surface.

16. Motor vehicle latch in accordance with claim 1, wherein the bending is at least 180 degrees.

17. Motor vehicle latch in accordance with claim 1, wherein bending one of the first or second locking components at its respective first or second free end increases a height of the respective first or second free end that abuts the first or second ratchet surface of the other locking component.

18. Motor vehicle latch in accordance with claim 1, wherein, before bending one of the first or second locking components at its respective first or second free end, a height of the respective first or second free end is narrower than the first or second ratchet surface of the other locking component.

19. Motor vehicle latch in accordance with claim 1, wherein the bent first or second locking component is assigned to a supplementary metal sheet having a thickness that offsets the difference between a height of the bent free end and a thickness of the other locking component.

20. Motor vehicle latch in accordance with claim 19, wherein a thickness of the first or second ratchet surface of the other locking component is equal to the height of the bent free end.

* * * * *